US006523470B2

(12) United States Patent
Kolbe et al.

(10) Patent No.: US 6,523,470 B2
(45) **Date of Patent: *Feb. 25, 2003**

(54) PRINTING CYLINDER

(75) Inventors: Wilfried Kolbe, Gülzow (DE); Klaus Schirrich, Bielefeld (DE); Manfred Terstegen, Bielefeld (DE); Bodo Steinmeier, Bielefeld (DE)

(73) Assignee: Fischer & Krecke GmbH & Co., Bielefeld (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/489,729

(22) Filed: Jan. 21, 2000

(65) Prior Publication Data

US 2002/0056387 A1 May 16, 2002

(30) Foreign Application Priority Data

Feb. 1, 1999 (EP) ..... 99102033

(51) Int. Cl.[7] ..... B41F 13/10; B41F 7/00; B41F 5/00; B41F 9/02

(52) U.S. Cl. ..... 101/375; 101/216; 101/212; 101/218; 101/152; 101/376

(58) Field of Search ..... 101/375, 216, 101/376, 218, 212, 152

(56) References Cited

U.S. PATENT DOCUMENTS

| | | | | | |
|---|---|---|---|---|---|
| 3,378,902 A | | | 4/1968 | Hoexter | |
| 4,383,483 A | | | 5/1983 | Moss | |
| 4,812,219 A | | * | 3/1989 | Sattrup et al. | 101/375 |
| 5,490,458 A | | * | 2/1996 | Stuart | 101/375 |
| 5,507,228 A | | * | 4/1996 | Schulz | 101/375 |
| 5,735,206 A | | * | 4/1998 | Rossini | 101/216 |
| 5,983,799 A | | * | 11/1999 | Lane, III et al. | 101/375 |

FOREIGN PATENT DOCUMENTS

| | | |
|---|---|---|
| DE | 8532300 | 2/1986 |
| DE | 3525045 | 1/1987 |
| EP | 0076777 | 4/1983 |
| EP | 0225509 | 6/1987 |
| EP | 0732201 | 9/1996 |
| EP | 0769373 | 4/1997 |
| FR | 785978 | 8/1935 |

OTHER PUBLICATIONS

Patent Abstracts of Japan, vol. 97, No. 5, regarding JP 09 001914, Jan., 1997.

Patent Abstracts of Japan, vol. 96, No. 2, regarding JP 07 256867, Oct., 1995.

Mosstype Co. catalogue. No date.

ETP Transmission AB catalogue, Sep. 1991.

D.R. Barton, "Composite Plate Cylinders Improve Productivity," *Flexo*, Aug. 1995.

* cited by examiner

*Primary Examiner*—John S. Hilten
*Assistant Examiner*—Marvin P. Crenshaw
(74) *Attorney, Agent, or Firm*—Richard M. Goldberg

(57) ABSTRACT

A printing cylinder with a cylinder core (10), on which a carbon fiber-containing casing (20) is disposed, wherein the casing (20) is self-supporting and held at a distance from the peripheral surface (18) of the cylinder core (10) by disks (22) disposed at the two ends.

8 Claims, 1 Drawing Sheet

PRINTING CYLINDER

BACKGROUND OF THE INVENTION

The specification relates to a printing cylinder with a cylinder core of metal, on which a carbon fiber-containing casing is disposed.

In the case of a printing machine, the printing length is determined by the effective diameter of the printing cylinder carrying the blocks. To avoid the need for a special cylinder with the associated bearing constructions for each printing length that may be desired, it is known that an exchangeable casing, which is referred to as a sleeve and then determines the effective diameter and, with that, the printing length, may be pushed onto the peripheral surface of the cylinder.

In the EP-A-0 732 201, a printing cylinder of this type is described, for which the sleeve has a multilayer construction. Two layers of a composite material, reinforced by carbon fibers, form an interstitial space, which is filled with a plastic foam. The inner surface of the sleeve lies tightly against the peripheral surface of the cylinder core, which consists of steel, so that the relatively high radial forces, which arise during the printing process, can be transferred by the relatively soft foam layer of the sleeve to the rigid cylinder core.

It is a disadvantage of this construction that, with the help of the sleeve, only a limited extension of the printing length is attained, because the thickness of the sleeve would have to be so large for larger printing lengths, that the required deformation resistance and size accuracy of the sleeve could no longer be guaranteed. A further disadvantage consists therein that the exchanging of sleeves is relatively work intensive, since the sleeve lies with all of its surface on the cylinder core and large frictional forces would thus have to be overcome when pushing the sleeve on or pulling it off. To reduce these frictional forces, it is known that compressed air may be passed into the interior of the cylinder core, the compressed air entering over radial openings in the interstitial space between the cylinder core and the sleeve.

In the EP-A-0 769 373, a printing cylinder is disclosed, for which the casing, which determines the printing length, has axle stubs with smaller diameters at both axial ends and is mounted directly in the machine frame. A steel shaft, which extends through the casing and is surrounded by the latter at a distance, serves merely to lift the casing from the bearings during an exchange of casings and to hold it so that it can be pulled axially from the shaft.

SUMMARY OF THE INVENTION

It is an object of the invention to provide a printing cylinder, for which, without affecting the printing quality, the printing length can be varied over a wider range by exchanging the casing.

Pursuant to the invention, this objective is accomplished for a printing cylinder of the type described above, owing to the fact that the casing is selfsupporting and held at a distance from the peripheral surface of the cylinder core by disks disposed in the region of the two ends.

In this connection, the expression "self-supporting" means that the casing has a sufficiently high inherent stiffness and that, although it is supported only at the ends by the disks on the cylinder core, it can withstand the radial forces, which arise during the printing process, so that the deformations, occurring in the casing, remain within permissible tolerance limits. It has turned out that this property of the casing can be attained through the use of a material, consisting of or reinforced with carbon fibers. Because of the relatively low relative density of such a material, the total weight and the moment of inertia of the casing remain relatively low; this has an advantageous effect on the quiet running of the printing machine and on the handling properties of the casing or of the printing cylinder as a whole. Since the casing is held at a distance from the peripheral surface of the cylinder core, the effective diameter of the casing is not determined only by the layer thickness of the sleeve, as it is in the case of conventional sleeves. Instead, it is determined primarily by the distance between the casing and the cylinder core. This permits the use of casings with relatively large diameters, so that correspondingly long printing lengths can be attained.

A further advantage of the invention consists therein that the casing can be pulled from the cylinder core significantly more easily, since it is supported at the cylinder core only by the disks disposed at the ends, so that only relatively low frictional forces arise.

The two disks may be produced from a material, which differs from that of the casing, such as steel or aluminum. Alternatively, however, they can also consist of the same material as the casing or even be constructed in one piece with the casing. Likewise it is possible to construct disks with bearing journals, with which the casings can be mounted directly in the machine frame.

Preferably, the cylinder core is a printing cylinder, which can also be used without the casing. In this case, the printing cylinder can be adjusted to a minimum printing length, in that the casing is simply omitted. The blocks can then be disposed on a conventional sleeve, which is pushed onto the printing cylinder, Alternatively, however, they can also be clamped directly on the peripheral surface of the cylinder core.

It is furthermore possible to increase the printing length even further by pushing a conventional sleeve on the outer periphery of the casing.

Preferably, in a known manner, the cylinder core has a compressed air line, from which radial openings lead to the peripheral surface. When the cylinder core is used without a casing, it becomes easier to push on or pull off a conventional sleeve. When it is used with a casing, the possibility exists of producing an overpressure in the interstitial space between the cylinder core and the casing. The pushing of a conventional sleeve onto the outer periphery of the casing can also be facilitated by radial openings in the casing. In case of need, the compressed air system can also be used to pretension the casing from inside, in order to affect the bulging.

BRIEF DESCRIPTION OF THE DRAWINGS

In the following, examples of the invention are described in greater detail by means of the drawing, in which.

DETAILED DESCRIPTION

Figure 1:
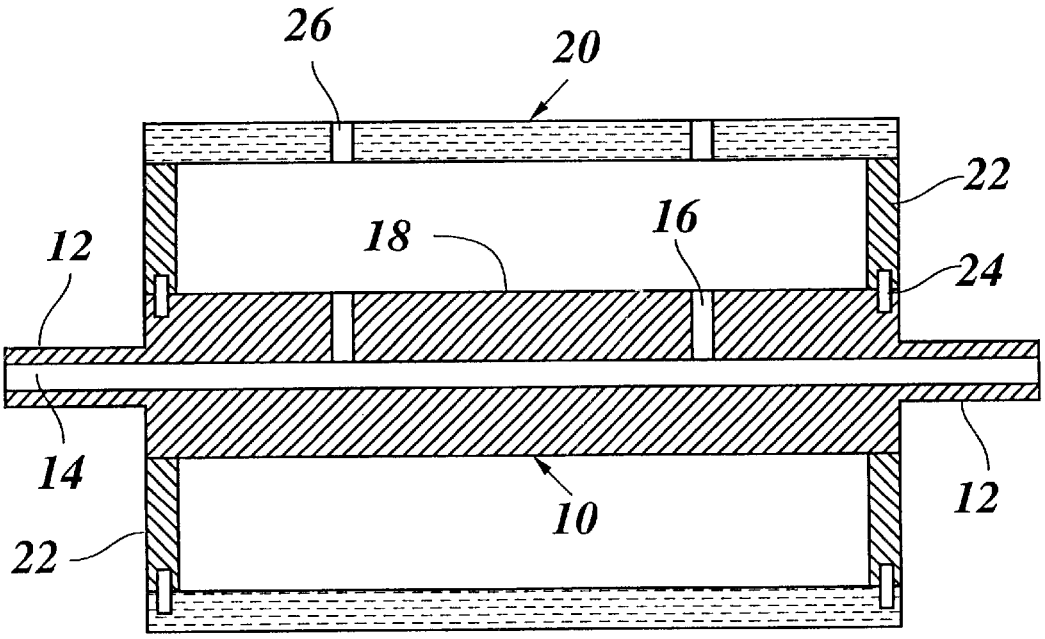
FIG. 1 shows a longitudinal section through an inventive printing cylinder and FIG. 2 shows a printing cylinder of a modified example.

The printing cylinder, shown in FIG. 1, has a cylinder core 10, which preferably is formed by a conventional printing cylinder of steel and is provided at both ends with axle stubs 12, which enable it to be mounted in a machine frame, which is not shown. Furthermore, as is known for printing cylinders, the cylinder core 10 has an axial borehole 14, over which compressed air can be supplied. The compressed air can then emerge over radial boreholes 16 at the peripheral surface 18 of the cylinder core.

The cylinder core 10 is surrounded at a distance by a cylindrical casing 20, which is formed by a tubular body of a carbon fiber composite material. Such tubular bodies of carbon fiber composite material were previously used, for example, as path-guiding rollers in printing machines or optionally also as printing cylinders for smaller printing lengths. Typically, these tubular bodies have a framework of diagonally wound carbon fibers, which are embedded in a plastic matrix.

The casing 20 is closed off at both ends by flat disks 22 of steel or aluminum and is supported on the cylinder core 10 only by way of these disks. The disks 22 are connected non-rotationally with the cylinder core 10, as is symbolized in the drawing by wedges 24. Correspondingly, the casing 20 is also connected nonrotationally with the disks 22, so that the cylinder core 10 and the casing 20 together form a rigid, bending resistant and torsion resistant printing cylinder. Blocks, which are not shown, can be clamped on the outer peripheral surface of the casing 20. Alternately, a conventional sleeve, which then, in turn, carries the blocks, may also be pushed onto the casing 20. In order to make it easier to exchange such a sleeve, the casing 20 also has opening 26, with which the compressed air, emerging from the openings 16 of the cylinder core, can be passed on to the peripheral surface of the casing.

The dimensions of the printing cylinder may vary within a wide range. In particular, the external diameter of the printing cylinder can be varied within a wide range by exchanging the casing 20 including the associated disks 22. Because of the relatively small wall thickness of the casing 20 and the low relative density of this casing, the total weight and the moment of inertia of the printing cylinder do also not increase appreciably at large external diameters.

In a typical example, the working width of the printing cylinder is about 800 to 2,000 mm, the diameter of the cylinder core 10 is about 100 mm, corresponding to a minimum printing length of the order of a little more than 300 mm, and the outside diameter of the casing 20 is, for example, up to 400 mm. The wall thickness of the casing 20 is of the order of about 15 to 20 mm. Because of the carbon fiber-reinforced material, this wall thickness is sufficient to ensure the required inherent stiffness of the casing 20. The radial forces, acting on the outer surface of the casing during the printing process, are introduced into the two disks 22, without appreciable deformation of the casing 20. Since the forces are introduced into the cylinder core 10 in the vicinity of the axle stubs 12, a bending of the cylinder core 10 is largely avoided. Moreover, the bending stiffness of the printing cylinder as a whole is increased by the shell construction.

Figure 2:
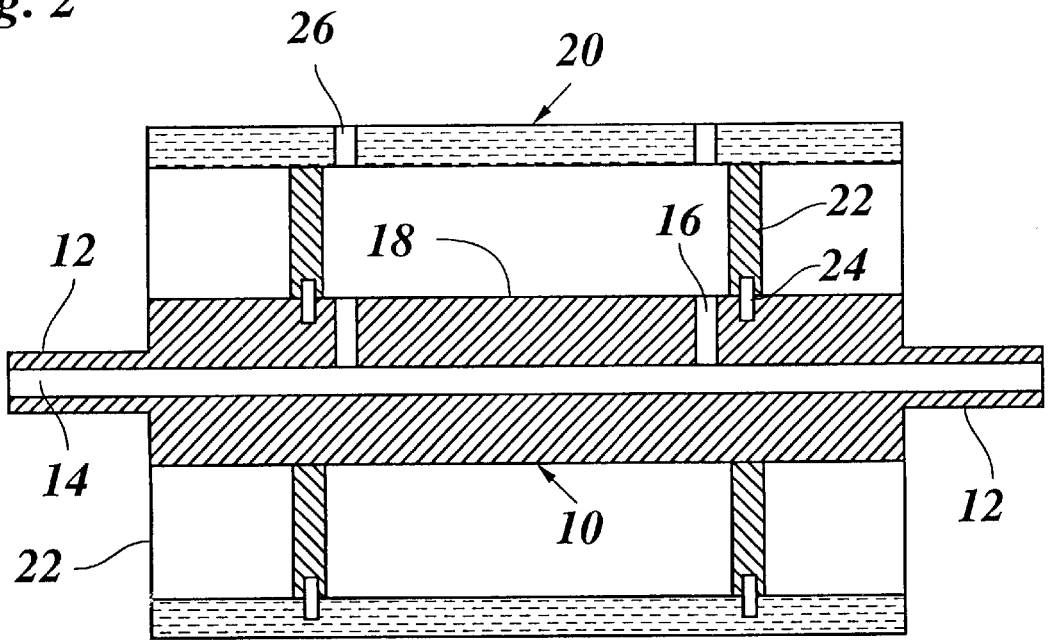

In FIG. 1, the disks 22 close off flush with the ends of the casing 20. On the other hand, FIG. 2 shows an example, in which the disks 22 are shifted inward somewhat with respect to the casing 22. By means of such a shifted arrangement of the disks 22, an improved distribution of the supporting forces over the length of the casing 20 is achieved and, with that, a significant decrease in the bending moments acting on the casing 20 during the printing. Admittedly, the bending moments, acting on the cylinder core 10 are increased somewhat in this case. However, these effects do not mutually cancel one another and, in the end result, a higher bending resistance of the printing cylinder is achieved.

What is claimed is:

1. A printing cylinder comprising:

a cylinder core, a carbon fiber-containing casing disposed as an outermost casing with an exposed outer surface on the cylinder core, the casing being self-supporting, and the carbon fiber-containing material of the casing including a carbon fiber composite material with a wound framework of carbon fibers and having sufficient rigidity to bear radial forces imparted thereon during a printing operation, and spaced apart disks for holding the casing at a distance from a peripheral surface of the cylinder core, the disks being disposed in a region of two axial ends of the cylinder core such that said casing is supported at at least two positions by said disks and such that a majority of length of said casing is out of contact with any supporting member.

2. The printing cylinder of claim 1, wherein the cylinder core is constructed for use as a printing cylinder independently of the casing.

3. The printing cylinder of claim 2, wherein:

the cylinder core has a channel for supplying compressed air and is connected through radial openings with the peripheral surface of the cylinder core, and the casing also has radial openings.

4. The printing cylinder of claim 2, wherein the disks are shifted inward with respect to the axial ends of the casing.

5. The printing cylinder of claim 1, wherein:

the cylinder core has a channel for supplying compressed air and is connected through radial openings with the peripheral surface of the cylinder core, and the casing also has radial openings.

6. The printing cylinder of claim 5, wherein the disks are shifted inward with respect to the axial ends of the casing.

7. The printing cylinder of claim 1, wherein the disks are shifted inward with respect to the axial ends of the casing.

8. A printing cylinder comprising:

a cylinder core, a carbon fiber-containing casing disposed on the cylinder core, the casing being self-supporting, and the carbon fiber-containing material of the casing including a carbon fiber composite material with a wound framework of carbon fibers, and spaced apart disks for holding the casing at a distance from a peripheral surface of the cylinder core, the disks being disposed in a region of two axial ends of the cylinder core such that said casing is supported at at least two positions by said disks and such that a majority of length of said casing is out of contact with any supporting member, the disks being shifted inward with respect to axial ends of the casing.

* * * * *